US010395874B2

(12) United States Patent
Wyatt et al.

(10) Patent No.: US 10,395,874 B2
(45) Date of Patent: Aug. 27, 2019

(54) AUXILIARY SWITCH

(71) Applicant: SAFRAN ELECTRICAL & POWER, Blagnac (FR)

(72) Inventors: Christopher Kenneth Wyatt, Bradenton, FL (US); James Broadwell, Parrish, FL (US); Dean Morgan, Lakeland, FL (US)

(73) Assignee: SAFRAN ELECTRICAL & POWER, Blagnac (FR)

( * ) Notice: Subject to any disclaimer, the term of this patent is extended or adjusted under 35 U.S.C. 154(b) by 93 days.

(21) Appl. No.: 15/883,264

(22) Filed: Jan. 30, 2018

(65) Prior Publication Data

US 2018/0218867 A1 Aug. 2, 2018

Related U.S. Application Data

(60) Provisional application No. 62/453,157, filed on Feb. 1, 2017.

(51) Int. Cl.

| | |
|---|---|
| ***H01H 71/46*** | (2006.01) |
| ***H01H 71/08*** | (2006.01) |
| ***H01H 50/04*** | (2006.01) |
| ***H01H 9/00*** | (2006.01) |
| ***H01H 1/58*** | (2006.01) |
| ***H01H 50/54*** | (2006.01) |
| *H01H 11/00* | (2006.01) |

(52) U.S. Cl.

CPC ..... *H01H 71/46* (2013.01); *H01H 1/5805* (2013.01); *H01H 9/0066* (2013.01); *H01H 50/045* (2013.01); *H01H 50/541* (2013.01); *H01H 71/08* (2013.01); *H01H 11/0006* (2013.01); *H01H 50/545* (2013.01); *H01H 2071/467* (2013.01)

(58) Field of Classification Search

CPC ..... H01H 1/5805; H01H 50/045; H01H 71/46

See application file for complete search history.

(56) References Cited

FOREIGN PATENT DOCUMENTS

| | | | |
|---|---|---|---|
| CN | 2914311 | Y | 6/2007 |
| DE | 19528410 | A1 | 2/1996 |
| JP | S55-115233 | A | 9/1980 |
| WO | 00/75944 | A1 | 12/2000 |
| WO | 2011/109036 | A1 | 9/2011 |

OTHER PUBLICATIONS

International Search Report and Written Opinion, PCT/US2018/015875, dated May 4, 2018, 15 pages.

*Primary Examiner* — Ramon M Barrera

(74) *Attorney, Agent, or Firm* — Rankin, Hill & Clark LLP

(57) ABSTRACT

An auxiliary switch includes a housing including a first housing part and a second housing part separate from and releasably connected to the first housing part. A printed circuit board is fixedly mounted within the housing and has an electrical pad and an electrical contact connected to the electrical pad. A terminal conductor is electrically connected to the printed circuit board. An actuator mechanism is mounted within the housing and has an electrical contactor engaged to the terminal conductor. The actuator mechanism is configured to move within the housing and at least partially displace the electrical contact while maintaining engagement between the contactor and the terminal conductor.

20 Claims, 5 Drawing Sheets

AUXILIARY SWITCH

BACKGROUND

Some known auxiliary switches use off the shelf stand-alone micro switches, and other known auxiliary switches use mating stamped contacts. And these known auxiliary switches typically require adjustments during assembly. However, auxiliary switches in relay/contactors are difficult to actuate, difficult to adjust during assembly, and/or expensive in the aerospace industry.

SUMMARY

According to one aspect, an auxiliary switch comprises a housing including a first housing part and a second housing part separate from and releasably connected to the first housing part. A printed circuit board is fixedly mounted within the housing and has an electrical pad and an electrical contact connected to the electrical pad. A terminal conductor is electrically connected to the printed circuit board. An actuator mechanism is mounted within the housing and has an electrical contactor engaged to the terminal conductor. The actuator mechanism is configured to move within the housing and at least partially displace the electrical contact while maintaining engagement between the contactor and the terminal conductor.

According to another aspect, an auxiliary switch comprises a housing including a first housing part and a second housing part separate from and releasably connected to the first housing part. A first printed circuit board is fixedly mounted within the housing and has a first electrical pad and a first electrical contact connected to the first electrical pad. A second printed circuit board is fixedly mounted within the housing and has a second electrical pad and a second electrical contact connected to the second electrical pad. A terminal conductor is electrically connected to each of the first and second printed circuit boards. An actuator mechanism is mounted within the housing and has an electrical contactor engaged to the terminal conductor. The actuator mechanism is configured to move within the housing and at least partially displace each of the first and second electricals contact while maintaining engagement between the contactor and the terminal conductor. In a first position of the actuator mechanism an electrical connection between the first printed circuit board and the terminal conductor is closed and an electrical connection between the second printed circuit board and the terminal conductor is open. In a second position of actuator mechanism an electrical connection between the first printed circuit board and the terminal conductor is open and an electrical connection between the second printed circuit board and the terminal conductor is closed.

DETAILED DESCRIPTION

Figure 1:
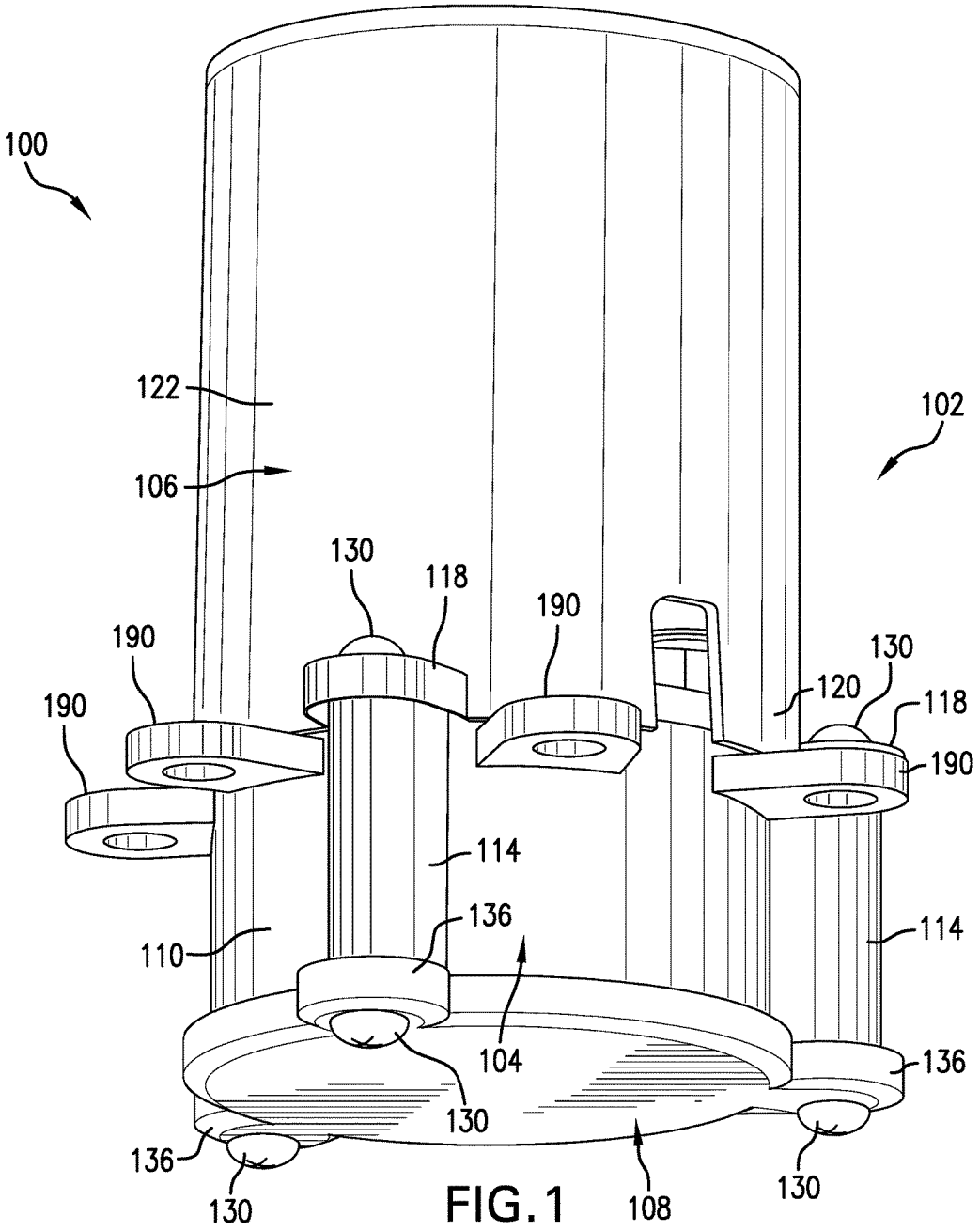
FIG. 1 is a perspective view of an auxiliary switch according to the present disclosure.
Figure 2:
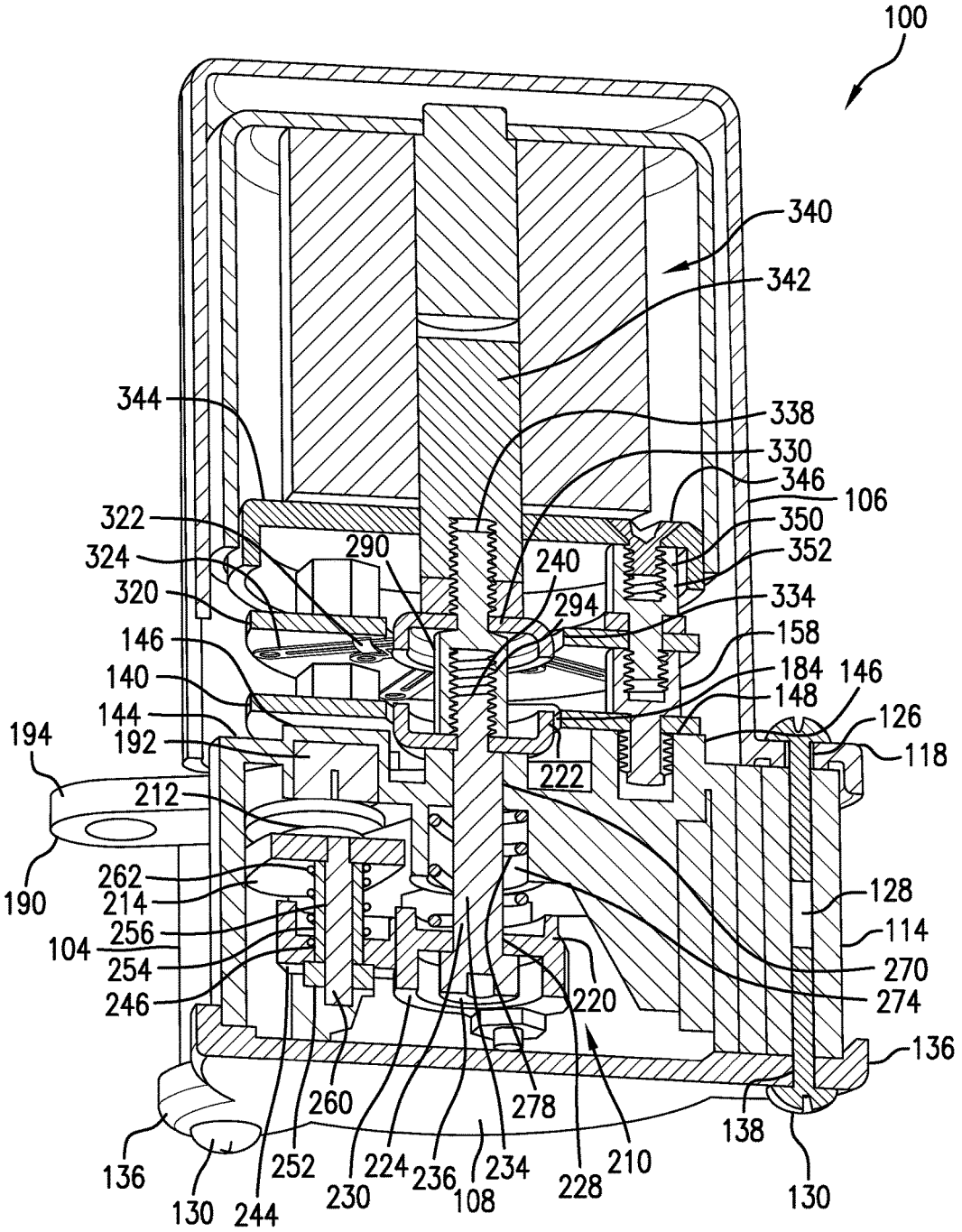
FIG. 2 is a cross-sectional view of the auxiliary switch of FIG. 1.
Figure 3:
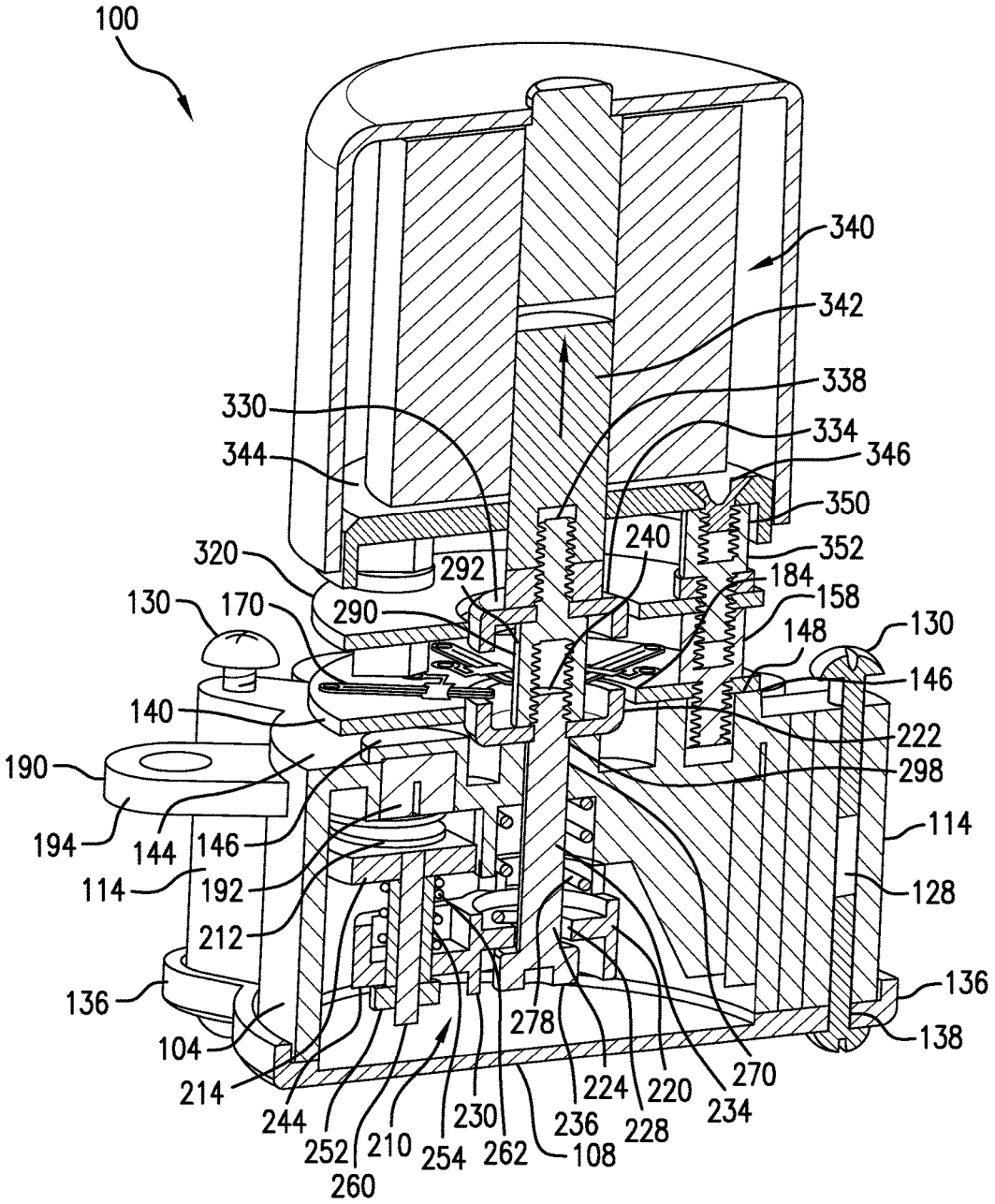
FIG. 3 is a cross-sectional view of the auxiliary switch of FIG. 1 with an upper housing part of the auxiliary switch removed.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-3 illustrate an auxiliary switch 100 according to the present disclosure. The auxiliary switch 100 generally includes a housing 102, which by way of example can be generally cylindrical in shape. The housing 102 can be defined by a first housing part 104, a separate second housing part 106 secured to an upper portion of the first housing part 104, and a separate cover member 108 secured to a lower portion of the first housing part 104.

To assemble the housing 102, an outer surface 110 of the first housing part 104 can include spaced mounting bosses 114 which extend from the upper portion to the lower portion of the first housing part 104. The second housing part 106 can include spaced mounting tabs 118 extending outwardly from a lower edge portion 120 of an outer surface 122. The mounting tabs 118 correspond to the mounting bosses 114, each mounting tab 118 including an opening 126 which is aligned with a bore 128 extending longitudinally through each mounting boss 114.

Fasteners, such as the depicted screws 130, extend through the openings 126 and are threadingly engaged in the bores 128 of the mounting bosses 114. Similarly, the cover member 108 can include spaced mounting tabs 136 having openings 138, which are aligned with the bores 128 of the mounting bosses 114. The fasteners (e.g., the screws 130) extend through the openings 138 and threadingly engage the bores 128. This arrangement of the first and second housing parts 104, 106 and the cover member 108 allows for ease of disassembly of the auxiliary switch 100. It should be appreciated that alternative configurations of the auxiliary switch 100 are contemplated.

As shown in FIGS. 2-3, a printed circuit board (PCB) 140 is fixedly mounted within the housing 102. The first housing part 104 includes a support wall 144 provided with mounting seats 146 having apertures 148. The PCB 140 is positioned on the support wall 144 and includes apertures 154 (FIG. 5A) that are aligned with the mounting seat apertures 148. As will be described below, bolts 158 fixedly mount the PCB 140 to the support wall 144.

Figure 5A:
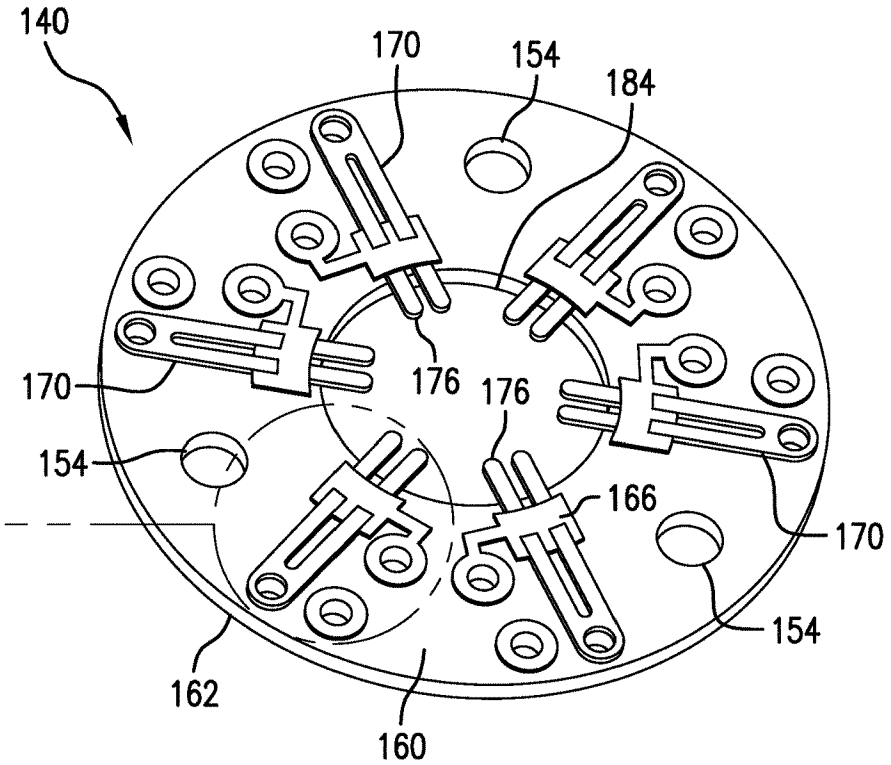
FIG. 5A is a perspective view of a printed circuit board of the auxiliary switch of FIG. 1.
Figure 5B:
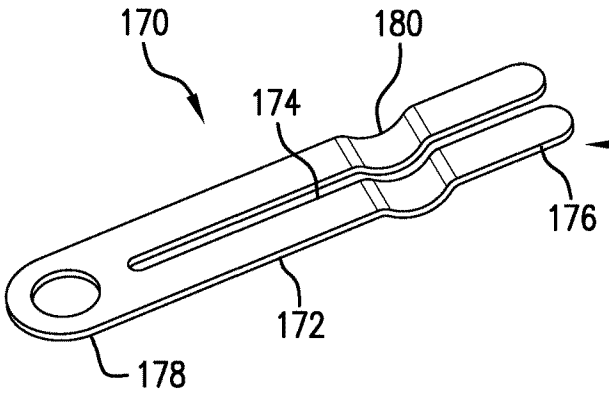
FIG. 5B is an enlarged view of an electrical contact of the printed circuit board.

The features of the PCB 140 are best depicted in FIGS. 5A and 5B. The PCB 140 includes a first side 160 and a second opposite side 162. At least one electrical pad 166 is embedded in the PCB 140 and at least one electrical contact 170 is secured to one of the first and second sides 160, 162 and is electrically connected to the at least one electrical pad 166. In the depicted embodiment, the electrical contact 170 is a bifurcated leaf contact having a body 172 with an elongated slit 174 extending along a majority length of the body 172 from a first end portion 176 toward a second end portion 178.

The body 172 further includes an arcuate shaped section 180. The electrical contact 170 is secured to the first side 160 of the PCB 140 with the arcuate shaped section 180 embedded in the PCB 140 beneath the electrical pad 166 and the first end portion 176 projecting into a centrally located through hole 184 defined in the PCB 140. With the cylindrical shape of the auxiliary switch 100, the PCB 140 has a corresponding disc shape. Further, according to one aspect, the at least one electrical pad 166 and the at least one electrical contact 170 are a plurality (e.g., six) of electrical pads 166 and corresponding electrical contacts 170 equally spaced on the first side 160 of the PCB 140 in a radial manner.

With reference back to FIGS. 2 and 3, the auxiliary switch 100 includes at least one terminal conductor 190 electrically connected to the PCB 140. In the depicted aspect, the terminal conductor 190 includes a mounting portion 192 and a connecting portion 194. The mounting portion 192 is received in a cavity defined by the mounting seat 146 and is adapted to be threadedly engaged by the bolt 158. The connecting portion 194 projects outwardly from the outer surface 110 of the first housing part 104. The number of terminal conductors 190 correspond to the number of electrical pads 166 and electrical contacts 170 provided on the PCB 140 and, as depicted, the auxiliary switch 100 includes six spaced terminal conductors 190 extending from the first housing part 104.

Figure 4:
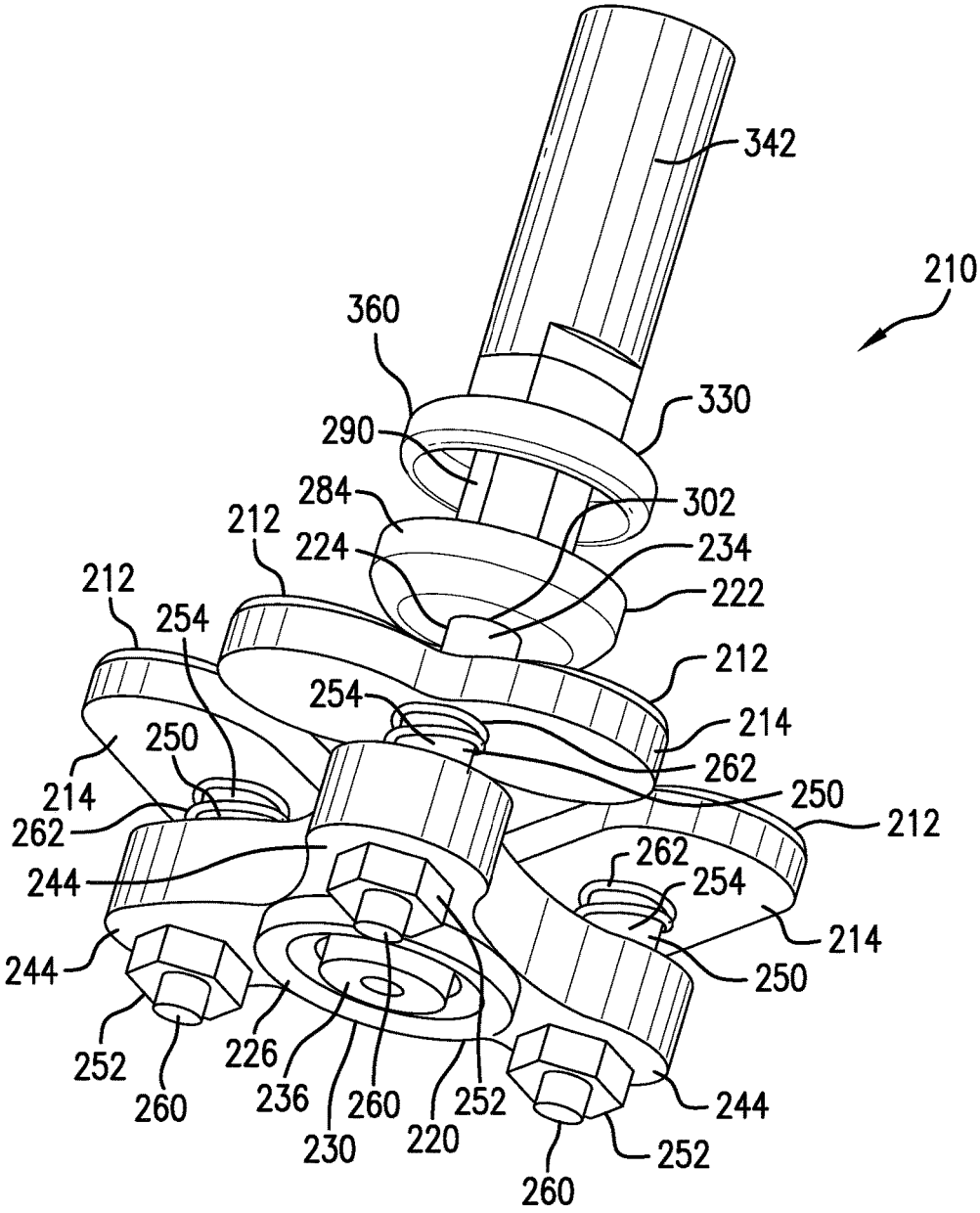
FIG. 4 is a perspective view of an exemplary actuator mechanism of the auxiliary switch of FIG. 1.

The exemplary auxiliary switch 100 further comprises an actuator mechanism 210 mounted within the housing 102 and configured to move within the housing 102 and at least partially displace the electrical contact 170 of the PCB 140 while maintaining engagement between the terminal conductor 190 and a corresponding electrical contactor 212 secured to a support member 214. An exemplary embodiment of the actuator mechanism 210 is depicted in FIGS. 2-4.

The actuator mechanism 210 includes a base 220, the support member 214 mounted to the base 220, and an actuator member 222 mounted to the base 220. With the illustrated six electrical pads 166 and corresponding six electrical contacts 170 provided onto PCB 140, the actuator mechanism 210 includes a corresponding number of electrical contactors 212 for the terminal conductors 190. In the depicted aspect of the actuator mechanism 210, three support members 214 are mounted to the body 226. Each support member 214 is provided with a pair of electrical contactors 212 which are electrically connected to two of the terminal conductors 190.

According to one aspect, an elongated support 224 is mounted to and extends from the base 220. More particularly, the base 220 includes a body 226 having a central opening 228 extending therethrough. A collar 230 extends downwardly from the body 226 and surrounds the opening 228. The support 224 is defined by an elongated shaft 234 having an enlarged head portion 236 located at one end and a threaded portion 240 located at an opposite end.

In assembly, the shaft 234 is inserted through the opening 228 with the head portion 236 surrounded by the collar 230 and abutting the body 226. The body 226 of the actuator mechanism 210 further includes a mounting portion 244 for each of the support members 214. As depicted, the mounting portion 244 includes an opening 246 which receives an insert 250. The insert 250 can be defined by a head portion 252 and a shaft 254 with a bore 256 extending through both the head portion 252 and shaft 254.

A rod 260 is received in the bore 256 and has one end threadingly engaged to the head portion 252 and an opposite end threadedly engaged to the support member 214. A first biasing member such as a spring 262 surrounds the shaft 254 of the insert 250 and is interposed between the mounting portion 244 and the support member 214. The first biasing member 262 biases the electrical contactor 212 toward the terminal conductor 190 which in turn maintains connection between the electrical contactor 212 and the terminal conductor 190 during movement of the actuator mechanism 210 within the housing 102.

Further depicted in FIGS. 2 and 3, the support wall 144 of the first housing part includes an opening 270 which receives the shaft 234 of the actuator mechanism support 224. A collar 274 depends from the support wall 144 and surrounds the opening 270. A second biasing member 278, for example a second spring, is at least partially supported within the collar 274 and is interposed between the support wall 144 and the body 226 of the actuator mechanism 210.

The actuator member 222 is reciprocally received in the through hole 184 of the PCB 140 and is configured to be in direct contact with each electrical contact 170 on the PCB 140. As shown, the actuator member 222, which can be cup or bowl shaped, has an outer wall portion 284 which is in direct contact with the first end portion 176 of each electrical contact 170. The actuator member 222 is fixed to that end portion of the shaft 234 of the support 224 in an elevated position relative to the electrical contactor 212, and extends through the opening 270 provided in the support wall 144.

A member 290 is further secured the actuator member 222 on the support 224. The spacer member 290 can be in the form of a bolt with its head 292 provided with an opening 294. The threaded end portion 240 of the shaft 234 includes a shelf 298. The actuator member 222 includes an opening 302 dimension to receive the threaded end portion 240 with the actuator member 222 positioned or supported on the shelf 298. The threaded end portion 240 threadingly engages the spacer member opening 294 and the actuator member 222 is sandwiched between the head 292 and the shelf 298. With this arrangement, actuation of the actuator mechanism 210 moves the actuator mechanism 210 upwardly within the housing 102 thereby causing the outer wall portion 284 of the actuator member 222 to displace each electrical contact 170 off the electrical pad 166.

The movement of the actuator mechanism 210 from its non-actuated position depicted in FIGS. 2 and 3 moves the body 226 toward the support wall 144 which compresses the spring 268 between the body 226 and the support member 214 and the second spring 278 between the body 226 and the support wall 144. The second spring 278 is adapted to return the actuator mechanism 210 downwardly within the housing 102 to its non-actuated portion, which, in turn, moves each electrical contact 170 back onto the first side 160 of the PCB 140 and into electrical contact with each electrical pad 166. Further, the spring 268 maintains electrical contact between each electrical contactor 212 and corresponding terminal conductor 190 during the entire movement of the actuator mechanism 210 in the housing 102.

In the depicted embodiment of the auxiliary switch 100 of FIGS. 2 and 3, the PCB 140 is a first PCB 140 and the auxiliary switch 100 further includes a second PCB 320 fixedly mounted within the housing 102. It should be appreciated that the second PCB 320 is configured similarly to the first PCB 140, the second PCB 320 having at least one second electrical pad 322 and at least one second electrical contact 324 electrically connected to the second electrical pad.

Therefore, further description of the second PCB 320 will be omitted for conciseness. The terminal conductor 190 is electrically connected to the second PCB 320, and, the actuator mechanism 210 is configured to at least partially displace each second electrical contact 324 of the second PCB 320 while again maintaining engagement between the electrical contactors 212 and corresponding terminal conductors 190. More particularly, the actuator mechanism 210 includes a second actuator member 330 mounted to the base 220 and in direct contact with the second electrical contacts 324 provided on the second PCB 320.

Again, similar to the PCB 140, the second PCB 320 includes a through hole 334, each second electrical contact 324 having an end portion extending at least partially into the through hole 334. The second actuator member 330 is reciprocally received in the through hole 334. As depicted in FIG. 4, the second actuator member 330 is fixed to the support shaft 234 with the spacer member 290 interposed between the first and second actuator members 222, 330. The second actuator member 330 is supported on the head 292 of the spacer member 290 and includes an opening through which a threaded shaft 338 of the spacer member 290 is received.

According to one aspect, the actuator mechanism 210 includes a solenoid driven actuator 340 having a plunger 342 secured to the threaded shaft 338 of the spacer member 290. As shown, the second housing part 106 can include a support shelf 344 which supports the solenoid driven actuator 340 within the second housing part 106. Fasteners 346 fasten the support shelf 344 to heads 350 of bolts 352 which extend through the apertures located in the second PCB 320. Each bolt 352 is, in turn, threadedly engaged to a head of one of the bolts 158. In this manner, the second PCB 320 is in an overlapping arrangement with the first PCB 140 with the bolts 158, 352 being longitudinally aligned, secured to each other, and secured to the first and second PCBs 140, 320.

Similar to the actuator member 222, the second actuator member 330 includes an outer wall portion 360 which is in direct contact with each end portion of the second electrical contacts 324 extending into the through hole 334 provided on the second PCB 320. The second actuator member 330 is adapted to displace the second electrical contacts 324 off the surface of the second PCB 320 to electrically disconnect the second electrical contact 324 from the second electrical pads 322 provided on the second PCB 320.

In the arrangement of the auxiliary switch 100 depicted in FIGS. 2 and 3, in the non-actuated position of the actuator mechanism 210, the electrical contacts 170 are flush against the first side 160 of the first PCB 140 and are in electrical contact with the electrical pads 166. However, the second electrical contacts 324 provided on the second PCB 320 are displaced off the surface of the second PCB 320 by the second actuator member 330. Therefore, in the non-actuated position of the actuator mechanism 210, an electrical connection between the first PCB 140 and each terminal conductor 190 is closed and an electrical connection between the second PCB 320 and each terminal conductor 190 is opened.

Movement of the actuator mechanism 210 upwardly in the housing 102 to an actuated position, provides for an electrical connection between the first PCB 140 and each terminal conductor 190 being opened and an electrical connection between the second PCB 320 and each terminal conductor 190 being closed. However, it should be appreciated that the depicted arrangement of the auxiliary switch 100 is by way of example only and that the first and second actuator members 222, 330 can be arranged in such a fashion that movement of the actuator mechanism 210 from the non-actuated position to the actuated position displaces both of the electrical contacts 170, 324 off the respective first and second PCBs 140, 320, thereby opening the electrical connection between the first and second PCBs and the terminal conductors 190.

Accordingly, the six electrical contacts on the PCB 140 create a 6 pole single throw auxiliary switch 100. The PCB 140 can be assembled upright to form a normally closed switch or downward facing to form a normally open switch. In the depicted exemplary auxiliary switch 100, the first and second PCBs 140, 320 create a normally open 6 pole single throw switch and a normally closed 6 pole single throw switch. The two actuator members 222, 330 are mounted on the actuator mechanism 210 in order to actuate each set of switches.

The actuator member 222 lifts the set of electrical contacts 170 on the first PCB 140 when the auxiliary switch 100 is turned off. On the other hand, the other actuator member 330 displaces the second electrical contacts 324 back onto the second PCB 320 when the contactor is turned ON. In contrast to known designs, this configuration of the exemplary auxiliary switch 100 does not require any adjustments during the assembly process.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An auxiliary switch comprising:

a housing including a first housing part and a second housing part separate from and releasably connected to the first housing part;

a printed circuit board fixedly mounted within the housing and having an electrical pad and an electrical contact connected to the electrical pad;

a terminal conductor electrically connected to the printed circuit board; and an actuator mechanism mounted within the housing and having an electrical contactor engaged to the terminal conductor, wherein the actuator mechanism is configured to move within the housing and at least partially displace the electrical contact while maintaining engagement between the contactor and the terminal conductor.

2. The auxiliary switch of claim 1, wherein the actuator mechanism includes a base, the electrical contactor mounted to the base, and an actuator member mounted to the base and in direct contact with the electrical contact.

3. The auxiliary switch of claim 2, wherein a biasing member is interposed between the base and the electrical contactor, the biasing member biasing the electrical contactor toward the terminal conductor.

4. The auxiliary switch of claim 3, wherein an elongated support is mounted to and extends outwardly from the base, the actuator member fixed to the support in an elevated position relative to the electrical contactor.

5. The auxiliary switch of claim 4, wherein the actuator mechanism includes a solenoid driven actuator having a plunger secured to the support.

6. The auxiliary switch of claim 5, wherein the printed circuit board is mounted to a wall of one of the first and second housing parts, the wall of the one housing part including a bore sized to reciprocally received the support, the actuator member supported on the wall.

7. The auxiliary switch of claim 5, wherein the printed circuit board includes a through hole, the actuator member being reciprocally received in the through hole.

8. The auxiliary switch of claim 7, wherein the electrical contact has an end portion extending at least partially into the through hole.

9. The auxiliary switch of claim 8, wherein the electrical contact is a bifurcated leaf contact.

10. The auxiliary switch of claim 7, wherein the printed circuit board is a first printed circuit board, and further including a second printed circuit board fixedly mounted within the housing and having a second electrical pad and a second electrical contact connected to the second electrical pad, the terminal conductor electrically connected to the second printed circuit board, and the actuator mechanism configured to at least partially displace the second electrical contact while maintaining engagement between the electrical contactor and the terminal conductor.

11. The auxiliary switch of claim 10, wherein the actuator mechanism includes a second actuator member mounted to the base and in direct contact with the second electrical contact.

12. The auxiliary switch of claim 11, wherein the second printed circuit board includes a through hole, the second electrical contact has an end portion extending at least partially into the through hole, and the second actuator member reciprocally received in the through hole.

13. The auxiliary switch of claim 11, wherein the second actuator member fixed to the support, and further including a spacer member fixed to the support and interposed between the actuator member and the second actuator member.

14. An auxiliary switch comprising:

a housing including a first housing part and a second housing part separate from and releasably connected to the first housing part;

a first printed circuit board fixedly mounted within the housing and having a first electrical pad and a first electrical contact connected to the first electrical pad;

a second printed circuit board fixedly mounted within the housing and having a second electrical pad and a second electrical contact connected to the second electrical pad a terminal conductor electrically connected to each of the first and second printed circuit boards; and an actuator mechanism mounted within the housing and having an electrical contactor engaged to the terminal conductor, wherein the actuator mechanism is configured to move within the housing and at least partially displace each of the first and second electrical contacts while maintaining engagement between the contactor and the terminal conductor;

wherein in a first position of the actuator mechanism an electrical connection between the first printed circuit board and the terminal conductor is closed and an electrical connection between the second printed circuit board and the terminal conductor is open, wherein in a second position of actuator mechanism an electrical connection between the first printed circuit board and the terminal conductor is open and an electrical connection between the second printed circuit board and the terminal conductor is closed.

15. The auxiliary switch of claim 14, wherein the actuator mechanism includes a base, the electrical contactor being mounted to the base, a first actuator member mounted to the base and in direct contact with the first electrical contact, and a second actuator member mounted to the base and in direct contact with the second electrical contact.

16. The auxiliary switch of claim 15, wherein a biasing member is interposed between the base and the electrical contactor.

17. The auxiliary switch of claim 15, wherein a support shaft is mounted to and extends outwardly from the base, each of the first and second actuator members fixed to the support shaft, and further including a spacer member fixed to the support shaft and interposed between the first and second actuator members.

18. The auxiliary switch of claim 17, wherein the actuator mechanism includes a solenoid driven actuator having a plunger secured to the support shaft.

19. The auxiliary switch of claim 17, wherein the first printed circuit board includes a through hole, the first electrical contact has an end portion extending at least partially into the through hole, and the first actuator member reciprocally received in the through hole, and the second printed circuit board includes a through hole, the second electrical contact has an end portion extending at least partially into the through hole, and the second actuator member reciprocally received in the through hole.

20. The auxiliary switch of claim 15, wherein in the first and second printed circuit boards are secured to the first housing part in an overlapping arrangement, and the actuator mechanism is supported on the first housing part with the base suspended beneath the first housing part.

* * * * *